US008488981B2

(12) United States Patent
Yuasa et al.

(10) Patent No.: US 8,488,981 B2
(45) Date of Patent: Jul. 16, 2013

(54) FIXING DEVICE AND IMAGE FORMING APPARATUS USING THE SAME

(75) Inventors: Shuutaroh Yuasa, Kanagawa (JP); Masanao Ehara, Kanagawa (JP); Tadashi Ogawa, Tokyo (JP); Satoshi Ueno, Tokyo (JP); Hiroshi Seo, Kanagawa (JP); Takamasa Hase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 13/064,137

(22) Filed: Mar. 8, 2011

(65) Prior Publication Data

US 2011/0222876 A1 Sep. 15, 2011

(30) Foreign Application Priority Data

Mar. 11, 2010 (JP) ..... 2010-054308
Mar. 12, 2010 (JP) ..... 2010-055823

(51) Int. Cl.
*G03G 15/20* (2006.01)

(52) U.S. Cl.
USPC ..... 399/33; 399/67; 399/69; 399/328

(58) Field of Classification Search
USPC ..... 399/33, 67, 69, 328
See application file for complete search history.

(56) References Cited

U.S. PATENT DOCUMENTS 7,266,336 B2 9/2007 Ueno et al.
7,450,872 B2 11/2008 Ueno et al.
7,491,917 B2 2/2009 Ueno
7,715,774 B2 5/2010 Ueno
7,778,581 B2 8/2010 Seo et al.
7,783,240 B2 8/2010 Ito et al.
7,796,933 B2 9/2010 Ueno et al.
7,801,457 B2 9/2010 Seo et al.
7,817,952 B2 10/2010 Seo et al.
7,885,590 B2 2/2011 Seo et al.
2006/0029411 A1 2/2006 Ishii et al.
2007/0014600 A1 1/2007 Ishii et al.
2007/0280754 A1 12/2007 Ogawa et al.
2008/0025773 A1 1/2008 Ito et al.
2008/0063443 A1 3/2008 Yoshinaga et al.
2009/0060550 A1 3/2009 Seo
2009/0148205 A1 6/2009 Seo et al.
2009/0238593 A1* 9/2009 Kinouchi et al. ..... 399/67
2009/0245897 A1 10/2009 Seo et al.
2009/0297197 A1 12/2009 Hase (Continued)

FOREIGN PATENT DOCUMENTS

JP 2002287542 10/2002
JP 2007328159 12/2007
JP 2009025571 2/2009
JP 2009-092743 4/2009

*Primary Examiner* — Ryan Walsh
(74) *Attorney, Agent, or Firm* — Harness, Dickey & Pierce, P.L.C.

(57) ABSTRACT

A fixing device includes a fixing member, a pressure member, and a damage detecting unit. The fixing member includes a heat-insulating elastic layer, to which a conductive thin-film layer is provided. The pressure member presses against the fixing member to form a fixing nip. The damage detecting unit detects the electric resistance of the thin-film layer. The damage detecting unit detects a change in the electric resistance of the thin-film layer, thereby detecting damage to the fixing member. Depending on the extent of the damage, the condition of conveyance of a recording medium to the fixing nip is changed.

16 Claims, 5 Drawing Sheets

U.S. PATENT DOCUMENTS

2010/0061753 A1 3/2010 Hase
2011/0058863 A1 3/2011 Shinshi et al.
2011/0064450 A1 3/2011 Ishii et al.
2011/0064502 A1 3/2011 Hase et al.
2011/0176822 A1 7/2011 Ishii et al.
2011/0229162 A1 9/2011 Ogawa et al.
2012/0301162 A1 * 11/2012 Sasaki et al. ..... 399/33

* cited by examiner

FIXING DEVICE AND IMAGE FORMING APPARATUS USING THE SAME

CROSS-REFERENCE TO RELATED APPLICATIONS

The present application claims priority to and incorporates by reference the entire contents of Japanese Patent Application No. 2010-054308 filed in Japan on Mar. 11, 2010 and Japanese Patent Application No. 2010-055823 filed in Japan on Mar. 12, 2010.

BACKGROUND OF THE INVENTION

1. Field of the Invention

The present invention relates to a fixing device configured to be installed in an image forming apparatus to fix a toner image on a recording medium, and further relates to an image forming apparatus including the fixing device.

2. Description of the Related Art

In well-known electrophotographic image forming apparatuses, such as a printer, a facsimile machine, a copier, or a multifunction peripheral (MFP) having at least two of these functions, typically, there is widely used a configuration that an electrostatic latent image is formed on the surface of an image carrier such as an photosensitive element; the electrostatic latent image is developed into a visible image with toner which is developer; the developed toner image is transferred onto a recording medium such as a recording sheet, and the recording medium carries the image (the unfixed toner image) thereon; and a fixing device applies heat and pressure to the unfixed toner image on the recording medium thereby fixing the toner image on the recording medium. In the fixing device of this electrophotographic image forming apparatus, the recording medium carrying the unfixed toner image thereon is held in a fixing nip formed between rollers or belts opposed to each other or a combination of these, and heated while being subjected to pressure, which makes the unfixed toner image fixed on the recording medium.

Among such fixing devices, an electromagnetic induction heat-fixing device using a coil which generates a magnetic flux or magnetic field lines is known and already widely used. This electromagnetic induction heat-fixing device includes, for example, a fixing member such as a fixing roller provided with a thin-walled fixing sleeve having a heating layer on the outer circumference of a heat-insulating elastic layer, a pressure member such as a pressure roller which presses against the fixing member thereby forming a fixing nip, and an electromagnetic induction heating member which is placed close to or to be opposed to the outer circumferential surface of the fixing member and heats the fixing member by means of electromagnetic induction. The electromagnetic induction heating member is composed of a (exciting) coil, a core for covering the coil, a coil guide which holds the coil and causes the coil to be opposed to the fixing member, and the like. By passing a high-frequency alternating current through the coil of the electromagnetic induction heating member, a magnetic flux which is alternately switched in two ways, i.e., an alternating magnetic field is formed around the heating layer that the fixing sleeve or the like provided in the fixing member has, and an eddy current is generated in the heating layer by the alternating magnetic field, and the heating layer and, eventually, the fixing sleeve set in the fixing member is heated by Joule heat generated by electric resistance of the heating layer to the eddy current. By means of heat from the fixing member provided with the fixing sleeve heated in this way, toner on a recording medium conveyed to the fixing nip is fused, and by means of pressure from the pressure roller pressing against the fixing member at the fixing nip, the fused toner is fixed on the recording medium as a semi-permanent image.

To form the fixing nip and to ensure efficient heat generation, the fixing sleeve of the fixing member in this kind of electromagnetic induction heating method is formed into a thin-walled structure. Therefore, for example, if the fixing sleeve is a defective part and has some scratches from the beginning, or if heating runaway occurs, there is a problem that the fixing sleeve is easily damaged. Besides, the heat-insulating elastic layer located on the side of the inner circumference than the fixing sleeve having the heating layer is also subjected to the pressure from the pressure member such as a pressure roller via the fixing sleeve or the like for a long time to form the fixing nip; therefore, the heat-insulating elastic layer may be damaged with time.

To cope with the damage to a component of such a fixing device, for example, Japanese Patent Application Laid-open No. 2007-328159 discloses a conventional technology for detecting damage to a fixing belt. In the conventional technology, an energization prohibiting means is placed at the position opposed to a coil, which is an electromagnetic induction heating member, across an endless belt which is the fixing belt. The energization prohibiting means has an antenna which generates a voltage or electric current from a magnetic flux from the coil. Regardless of temperature of the endless belt, if the voltage or electric current generated in the antenna exceeds a predetermined amount, the energization prohibiting means prohibits energization of the coil. If the endless belt is not damaged, the antenna in the energization prohibiting means does not detect any voltage or electric current because the antenna is shielded from the coil by the endless belt. However, if the endless belt is damaged, the antenna is opposed to the coil because there is no endless belt in the damaged portion, and a voltage or electric current is generated in the antenna due to a magnetic flux from the coil; the damage to the endless belt is detected with this.

Using the conventional technology, breakage or damage of the endless belt can be detected by the action of the antenna of the energization prohibiting means. However, it is not possible to detect damage to a fixing roller which supports the endless belt. From the experience of the present applicant, this kind of fixing roller can be suddenly broken with time due to pressure contact with a pressure roller. That is, the conventional belt damage detection cannot resolve the problem of damage to the fixing roller.

Further, in the fixing device according to the conventional technology, the energization prohibiting means prohibits energization of the coil, so a fixing process and, eventually, image forming operation cannot be performed. However, when the fixing roller is damaged, in most cases, the damage begins in an end portion of the fixing roller, so the fixing device may be able to be still used depending on the size or type of a recording medium subjected to a fixing process. In this case, it is user-friendly or beneficial to a user, i.e., convenient for a user if an image forming apparatus can be used depending on a recording-medium feeding condition, such as the size or type of a recording medium, until the fixing roller is replaced.

SUMMARY OF THE INVENTION

It is an object of the present invention to at least partially solve the problems in the conventional technology.

According to an aspect of the present invention, a fixing device includes an electromagnetic induction heating member, a fixing member, a pressure member, and a damage detecting unit. The electromagnetic induction heating member includes a coil which is powered by application of an alternating voltage and generates an alternating magnetic flux by an alternating current passing therethrough. The fixing member includes a fixing sleeve, a heat-insulating elastic layer, and a conductive thin-film layer. The fixing sleeve is provided with a heating layer which is heated by the action of the alternating magnetic flux generated by the coil. The heat-insulating elastic layer is located on the inner circumference side of the fixing sleeve. The thin-film layer is provided to the heat-insulating elastic layer. The pressure member presses against the fixing member to form a fixing nip between the fixing member and the pressure member. The fixing device fixes an unfixed toner image on a recording medium conveyed to the fixing nip by heat from the fixing sleeve provided with the heating layer heated by the magnetic flux generated by the coil and pressure applied to the fixing member by the pressure member. The damage detecting unit detects the electric resistance of the thin-film layer. More specifically, the damage detecting unit detects a change in the electric resistance of the thin-film layer to detect damage to the fixing member. The fixing device changes the condition of conveyance of the recording medium to the fixing nip if the damage detecting unit detects damage to the fixing member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of the present invention is explained below with reference to the accompanying drawings.

Figure 1:
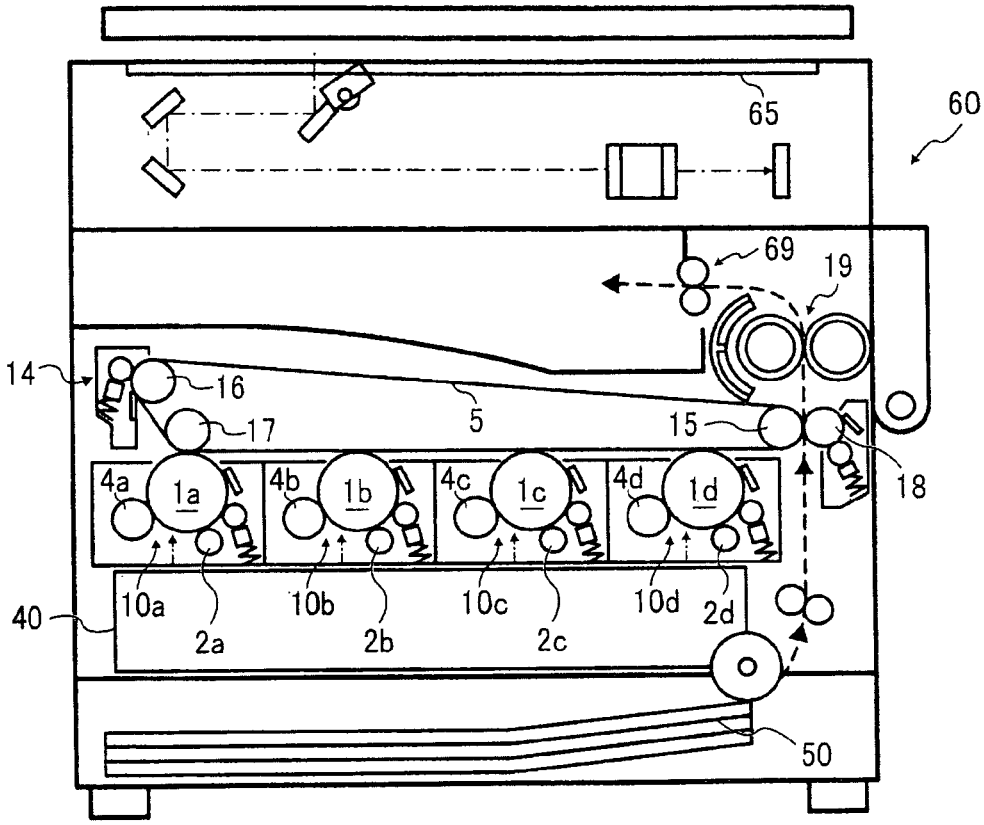
FIG. 1 is a schematic cross-sectional view showing an example of an image forming apparatus equipped with a fixing device according to an embodiment of the present invention.

First, an example of an image forming apparatus equipped with a fixing device according to an embodiment of the invention is explained with reference to FIG. 1. FIG. 1 is a schematic cross-sectional view of a full-color copier as an example of the image forming apparatus. The full-color copier shown in FIG. 1 as an example of the image forming apparatus is well known to those skilled in the art, so detailed description of the full-color copier is omitted, and the full-color copier is roughly described below.

As shown in FIG. 1, this copier includes four image forming units 10 (10*a*, 10*b*, 10*c*, and 10*d*) which mainly include four photosensitive elements 1 (1*a*, 1*b*, 1*c*, and 1*d*) and peripheral image forming devices, respectively; an endless belt-like intermediate transfer belt 5 which is an intermediate transfer body placed in contact with the surfaces of the four photosensitive elements 1 (1*a*, 1*b*, 1*c*, and 1*d*) at the position opposed to the photosensitive elements 1; a paper cassette 50 as a recording-medium container in which a stack of recording media such as recording sheets onto which a toner image primarily-transferred onto the intermediate transfer belt 5 will be secondarily transferred are contained; and the like. Incidentally, toner images which differ in color from one another, for example, a yellow toner image, a magenta toner image, a cyan toner image, and a black toner image are formed on the photosensitive elements 1 (1*a*, 1*b*, 1*c*, and 1*d*), respectively. The intermediate transfer belt 5 is a component which is generally supported by a plurality of rollers placed in contact with the inner surface and/or the outer surface of the intermediate transfer belt 5 and is driven to move in accordance with rotation of the roller. In the example shown in FIG. 1, the intermediate transfer belt 5 is supported by supporting rollers 15, 16, and 17, and is driven to rotate in a counter-clockwise direction in accordance with rotation of one of the supporting rollers 15, 16, and 17 which is subjected to a drive force from a drive source (not shown). Incidentally, the other supporting rollers other than the one driven by the drive source rotate in accordance with the rotation of the intermediate transfer belt 5. In each of the image forming units 10 (10*a*, 10*b*, 10*c*, and 10*d*), a charging member 2 (2*a*, 2*b*, 2*c*, 2*d*) which uniformly charges the photosensitive element 1 (1*a*, 1*b*, 1*c*, 1*d*) to the predetermined polarity, an exposure unit 40 which is a writing unit for writing an electrostatic latent image corresponding to an image scanned by a scanner unit 60 on the surface of the charged photosensitive element 1 (1*a*, 1*b*, 1*c*, 1*d*), a developing device 4 (4*a*, 4*b*, 4*c*, 4*d*) which develops the electrostatic latent image into a toner image with toner or the like, and the like are arranged around the photosensitive element 1 (1*a*, 1*b*, 1*c*, 1*d*) which is an image carrier. The developed toner images on the photosensitive elements 1 (1*a*, 1*b*, 1*c*, and 1*d*) are primarily transferred onto the intermediate transfer belt 5 in a superimposed manner.

As described above, different toner images are formed on the four photosensitive elements 1 (1*a*, 1*b*, 1*c*, and 1*d*); however, the image forming units 10 (10*a*, 10*b*, 10*c*, and 10*d*) have substantially the same configuration that a color toner image is formed on the photosensitive element 1 (1*a*, 1*b*, 1*c*, 1*d*) and the toner image is (primarily) transferred onto the intermediate transfer belt 5; therefore, in the description below, operation of the image forming apparatus is roughly explained with a, b, c, and d, alphabets of the alphanumerals, omitted accordingly.

In the copier shown in FIG. 1, an original set in the scanner unit 60 is scanned by an optical system of the scanner unit 60, and converted into electrical signals corresponding to respective color toners. Specifically, an illumination lamp is moved while emitting a light to an image of an original to be scanned which is set on an exposure glass 65. Then, a reflected light reflected from the original subjected to the light from the illumination lamp is focused onto a color sensor by using appropriate optical members, such as a mirror and a lens. The color image information of the original is read by the color sensor by each RGB (red, green, blue) color separation light, and converted into an electrical image signal, and then subjected to a color conversion process, a color correction process, a spatial-frequency correction process, etc. by an image processing unit or the like on the basis of an RGB color separation image signal, and original color image information corresponding to each of yellow, magenta, cyan, and black toners is obtained.

While the original information is processed in the scanner unit 60, in the image forming unit 10, the above-described components are driven, and, first, the photosensitive element 1 rotates in a clockwise direction. The photosensitive element 1 is uniformly charged by the charging member 2, and after that, an electrostatic latent image is formed on the photosensitive element 1 in such a manner that an electrical charge on the photosensitive element 1 is partially dissipated by exposure to a light from the exposure unit 40 corresponding to the electrical signal of the color image information of the original scanned by the scanner unit 60 described above. After that, color toner corresponding to the electrical charge of the electrostatic latent image is transferred onto the photosensitive element 1 via a developing roller in the developing device 4, and the electrostatic latent image is developed into a toner image. On the side of the inner surface of the intermediate transfer belt 5, primary transfer rollers (not shown) are placed to be opposed to the respective photosensitive elements 1 across the intermediate transfer belt 5. The primary transfer roller is in contact with the inner surface of the intermediate transfer belt 5, thereby forming an appropriate primary transfer nip between the photosensitive element 1 and the intermediate transfer belt 5 and applying a transfer voltage of the polarity opposite to the toner charging polarity of the toner image formed on the photosensitive element 1 to the primary transfer roller, thus a transfer electric field is formed between the photosensitive element 1 and the intermediate transfer belt 5, and the toner image on the photosensitive element 1 is electrostatically primarily transferred onto the intermediate transfer belt 5 which is driven to rotate in synchronization with the photosensitive element 1. In this manner, different color toner images are formed on the respective photosensitive elements 1, and the toner images are primarily transferred onto the intermediate transfer belt 5 sequentially from the upstream side one in the moving direction of the intermediate transfer belt 5 at the right timing so that the toner image is superimposed on the previously-transferred toner image on the intermediate transfer belt 5, thus a full-color toner image is formed on the intermediate transfer belt 5.

On the other hand, a recording medium is started being fed one by one from the paper cassette 50, which is a recording-medium container placed on the bottom inside a main body of the image forming apparatus, by an appropriate feed member, and conveyed to a pair of registration rollers (not shown) which is not yet driven to rotate. In the pair of registration rollers, a so-called loop is formed, thereby performing registration of the recording medium. The recording medium subjected to the registration is conveyed in accordance with rotation of the pair of registration rollers which is driven to rotate in synchronization with the full-color toner image formed on the intermediate transfer belt 5 by the primary transfer of the toner images, and the full-color toner image is secondarily transferred onto the recording medium at a secondary transfer nip formed between a secondary transfer backup roller 15, which is one of the supporting rollers of the intermediate transfer belt 5, and a secondary transfer roller 18 opposed to the secondary transfer backup roller 15. The recording medium onto which the full-color toner image is secondarily transferred is further conveyed to a fixing device 19 to be described below, which is installed on the downstream side in the recording-medium conveying direction. The recording medium is subjected to heat and pressure in the fixing device 19, thereby the full-color toner image is fixed on the recording medium as a semi-permanent image. After that, the recording medium is further conveyed and discharged into a recording-medium discharge unit, such as a copy receiving tray, via a pair of discharge rollers 69, thus the image forming operation is completed. Incidentally, secondary-transfer residual toner remaining on the intermediate transfer belt 5, i.e., residual toner which is not secondarily transferred onto the recording medium is removed and collected by an intermediate transfer cleaning unit 14 to prepare for next image forming operation.

Figure 2:
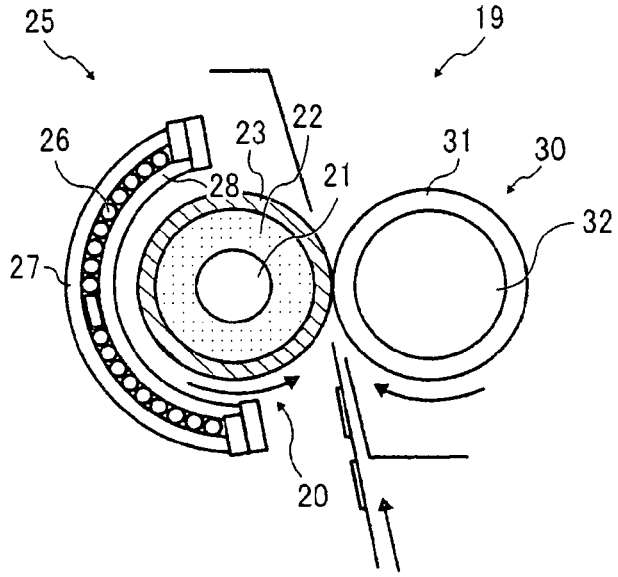
FIG. 2 is a schematic cross-sectional view showing an example of an electromagnetic induction heat-fixing device as the fixing device according to the embodiment.

Subsequently, the configuration and action of the fixing device 19 are further explained with reference to FIG. 2. FIG. 2 is a schematic cross-sectional view showing an example of an electromagnetic induction heat-fixing device to which the present embodiment is applied. As shown in FIG. 2, the fixing device 19 mainly includes an electromagnetic induction heating member 25, a fixing roller 20 as a fixing member opposed to the electromagnetic induction heating member 25, a pressure roller 30 as a pressure member which presses against the fixing roller 20, and, although not illustrated in FIG. 2, a guide plate for guiding a conveyed recording medium to a fixing nip, a separation plate for separating the recording medium come out of the fixing nip from the fixing roller 20, and the like. Further, a temperature detecting unit (a temperature sensor), such as a thermistor or a thermopile, for detecting the surface temperature of a fixing sleeve layer 23 of the fixing roller 20 to be described below is installed in the fixing device 19. Incidentally, an example of the guide plate (not shown) is explained. The guide plate is placed on the upstream side of the fixing nip formed between the fixing roller 20 and the pressure roller 30 pressing against the fixing roller 20 in the conveying direction of the recording medium and to be opposed to the surface of the recording medium carrying an unfixed toner image thereon. For example, the guide plate is configured as a spur guide plate that a plurality of spurs placed in contact with the image fixing surface are arranged in parallel with the width direction of the recording medium. Incidentally, it would be better to serrate the circumferential surface of the plurality of spurs to prevent the unfixed toner image from being scraped off when the spurs are in contact with the recording medium. The separation plate (not shown) is placed on the downstream side of the fixing nip in the recording-medium conveying direction so as to prevent a conveyance jam that the recording medium on which the toner image has been fixed at the fixing nip is adhered to the fixing roller 20 and wound around the fixing roller 20. Namely, by bringing a fore-end of the separation plate into contact with a leading end of the recording medium after completion of the fixing process, the recording medium is forcibly separated from the fixing roller 20.

The fixing roller 20 illustrated in FIG. 2 includes a cored bar 21, a heat-insulating elastic layer 22, and the fixing sleeve layer 23. The surface of the cored bar 21 made of aluminum (Al), stainless steel (SUS), or iron (Fe) is covered with the heat-insulating elastic layer 22, which is a well-insulated sponge layer made of polyurethane foam rubber or the like, with a thickness of about 2 to 15 millimeters. The outer circumference of the heat-insulating elastic layer 22 is covered with the fixing sleeve layer 23. The fixing roller 20 is configured to be about 30 to 50 millimeters in outer diameter. The fixing sleeve layer 23 has, for example, a multilayer structure including a base material layer, a first antioxidant layer, a heating layer, a second antioxidant layer, an elastic layer, and a release layer in the order of inside to outside. An example of the structure of the fixing sleeve layer 23 is explained in more detail; the base material layer is formed of stainless steel of about 40 micrometers; the first and second antioxidant layers are formed by strike plating of nickel with a thickness of 1 micrometer or less; the heating layer is formed of copper of about 10 micrometers; the elastic layer is formed of silicon rubber with a thickness of about 150 micrometers; the release layer is formed of PFA (tetrafluoroethylene perfluoroalkoxy vinyl ether copolymer) with a thickness of about 30 micrometers.

The electromagnetic induction heating member 25 includes a coil 26 (an exciting coil), a core 27 (an exciting-coil core), a coil guide 28, and the like. The coil 26 is that a roll of litz wire, a bunch of thin wires, extends in the width direction, which is a direction perpendicular to the sheet plane of FIG. 2, on the coil guide 28 placed close to the fixing roller 20 so as to cover a portion of the outer circumferential surface of the fixing roller 20. Incidentally, the coil guide 28 is made of a high heat-resistant resin material such as PET (polyethylene terephthalate) with a glass material content of about 45%, and holds the above-described coil 26 with respect to the outer circumferential surface of the fixing roller 20. A gap between the coil guide 28 and the fixing roller 20 is set to about 1.9 to 2.1 millimeters. The core 27 is formed of a ferromagnetic body such as ferrite having a relative permeability of about 2500, and is provided to form an efficient magnetic flux toward the heating layer of the fixing roller 20. The core 27 includes an arch core, a center core, a side core, etc.

As the pressure roller 30 provided as a pressure member, the one that a cylindrical member 32 made of iron and steel, aluminum, or the like is covered with an elastic layer 31 which is made of silicon rubber or the like and has a thickness of about 1 to 5 millimeters and a release layer which is made of PFA or the like and has a thickness of about 2.0 to 200 micrometers is used. Note that the release layer of the pressure roller 30 is omitted in FIG. 2. Incidentally, although not illustrated in the drawing, a heat source, such as a halogen heater, can be provided inside the cylindrical member 32 of the pressure roller 30 to enhance the efficiency of heating a recording medium at the fixing nip, and the pressure roller 30 can be heated by radiant heat from the heat source.

In the example of the fixing device 19 configured as described above shown in FIG. 2, the fixing roller 20 is driven to rotate in a counterclockwise direction as indicated by an arrow in FIG. 2 by a drive source (not shown) such as a drive motor, and the pressure roller 30 pressing against the fixing roller rotates in a clockwise direction as indicated by an arrow in accordance with the rotation of the fixing roller 20. Then, the heating layer of the fixing sleeve layer 23 provided to the fixing roller 20 is heated by a magnetic flux generated from the electromagnetic induction heating member 25 at the position opposed to the electromagnetic induction heating member 25. To heat the heating layer by the magnetic flux, first, a power supply unit having a variable-frequency oscillator circuit applies a high-frequency alternating voltage of 10 kHz to 1 MHz, preferably, 20 kHz to 800 kHz to the coil 26 thereby passing an alternating current through the coil 26, and magnetic field lines from the coil 26 toward the fixing sleeve 23 are switched to two ways by the action of the alternating current. When this alternating-current magnetic field is formed, an eddy current is generated in the heating layer of the fixing sleeve 23, and the heating layer is heated by Joule heat generated by the action of electric resistance of the heating layer to the flow of the eddy current, and the fixing sleeve layer 23 is heated. After that, the fixing sleeve layer 23 heated by the electromagnetic induction heating member 25 reaches the fixing nip between the fixing roller 20 and the pressure roller 30 in accordance with the rotation of the fixing roller 20, and applies heat to a recording medium held in the fixing nip thereby fusing unfixed toner of an unfixed toner image formed on the recording medium, and coupled with the action of pressure from the pressure roller 30 pressing against the fixing roller 20, the fused toner is fixed on the recording medium.

Figure 3:
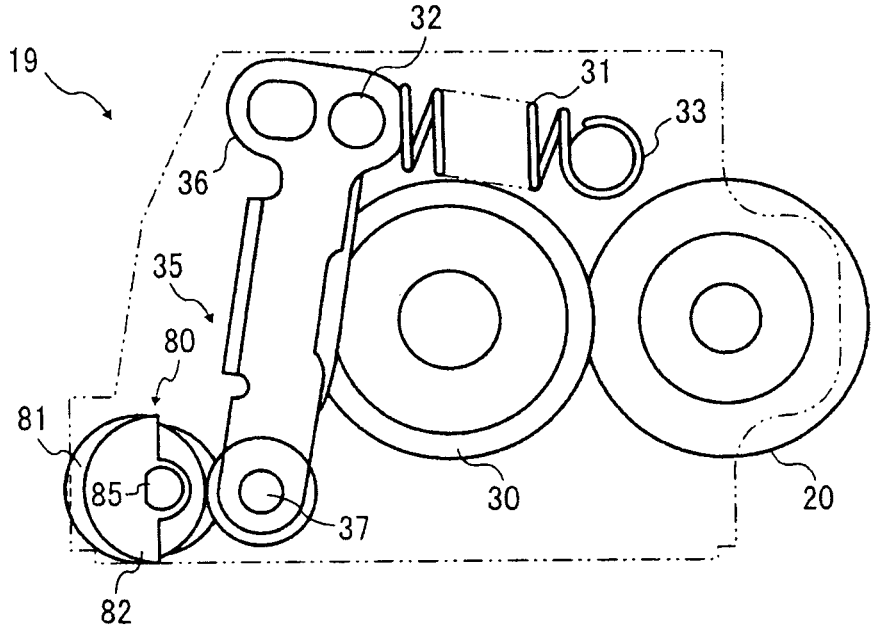
FIG. 3 is a side view for explaining how a pressure member presses against a fixing member in the fixing device according to the embodiment.

An example of a pressure adjusting unit capable of pressing the pressure roller 30 against the fixing roller 20 to form the fixing nip and adjusting the pressure to the fixing roller 20 is explained with reference to FIG. 3 showing a side view of the fixing device 19. In the pressure adjusting unit shown in FIG. 3, an end 32 of a biasing member 31 (a coil spring, in this example) of which an end 33 is fixed to the side of the fixing device 19 is connected to a link end 36 of a link 35. At this time, the biasing member 31 constantly applies a biasing force in a direction of keeping the link 35 away from the pressure roller 30 (to the left in FIG. 3). The other end of the link 35 to which the biasing member 31 is not connected is configured as a link supporting point 37. The link 35 is rotatably fixed to the fixing device 19 via the link supporting point 37. Besides, it is configured that the link 35 is pressed against a bearing into which a shaft of the pressure roller 30 is rotatably inserted or the body of the pressure roller shaft, etc., thereby pressing the pressure roller 30 against the fixing roller 20; at this time, the biasing member 31 applies the biasing force so that the link 35 normally turns to the left in FIG. 3, thereby preventing a pressing force from the pressure roller 30 from being applied to the fixing roller 20, so a cam mechanism 80 for pressing the link 35 to the side of the fixing roller 20 against the biasing force from the biasing member 31 is provided. The cam mechanism 80 includes a cam 81 and a filler 82. The cam 81 can rotate by a drive force from a drive source (not shown) such as a stepping motor. The filler 82 is semicircular in cross-section, and is connected to the cam 81 via a filler supporting point 85. In accordance with rotation of the cam 81 in a clockwise direction in this example shown in FIG. 3, a fore-end of the filler 82, which rotates around the filler supporting point 85 in the clockwise direction together with the cam 81, comes in contact with the link 35 and further presses the link 35, and as a result, the bearing and the shaft of the pressure roller 30 that the link 35 is in contact therewith move to the side of the fixing roller 20 against the biasing force from the biasing member 31, so that the pressure roller 30 can press against the fixing roller 20 at a desired pressing force. Incidentally, FIG. 3 is a diagram of the fixing device viewed from the opposite side to that is shown in the cross-sectional view in FIG. 2 and the like; therefore, note that the positions of the pressure roller 30 and the fixing roller 20 in FIG. 3 are switched from those in FIG. 2.

In this fixing device 19, contact temperature sensors (not shown) such as a thermistor are installed in contact with both end of the fixing sleeve layer 23 of the fixing roller 20 extending in a vertical direction with respect to the sheet plane of FIG. 2. In addition, a non-contact temperature sensor (not shown) such as a thermopile is installed on the central part of the fixing sleeve 23. These temperature sensors are installed to detect the surface temperature of the fixing sleeve layer 23. On the basis of the temperatures detected by these temperature sensors, an electric energy supplied to the electromagnetic induction heating member 25 is controlled (for example, when to apply an alternating voltage, an amount of the voltage, and the like are controlled), thereby controlling an amount of heat with which the electromagnetic induction heating member 25 heats the fixing sleeve layer 23. Incidentally, in the present embodiment, power supply to the electromagnetic induction heating member 25 is controlled so that the surface temperature of the fixing sleeve layer 23 at the time of implementation of the fixing process is 160° C. to 165° C. When a heat source, such as a halogen heater, is provided inside the pressure roller 30 as described above, temperature sensors, such as a thermistor and a thermopile, are installed on the side of the pressure roller 30 in the same manner as the fixing roller 20, and the temperature of the heat source is controlled.

The present embodiment is described as being applied to a specific example of the electromagnetic induction heat-fixing device as described above, it is not so limited. For example, the fixing roller 20 shown in the drawing is integrated with the fixing sleeve layer 23, and the fixing roller 20 and the fixing sleeve layer 23 are configured to be driven to rotate together by the drive source (not shown). Alternatively, for example, an endless belt-like fixing sleeve 23 can be configured to be separate from the fixing roller 20 and slide on the outer circumferential surface of the positionally-fixed fixing roller 20. When the fixing sleeve 23 is configured to be separate from the fixing roller 20, the pressure roller 30 is driven to rotate, and the separate fixing sleeve 23 slides on the outer circumferential surface of the positionally-fixed fixing roller 20 in accordance with the rotation of the pressure roller 30. In this case, it is preferable to install a fixing-sleeve anti-movement member for preventing the fixing sleeve 23 from moving in a direction of the long side or axis of the fixing roller 20 while the fixing sleeve 23 is rotating.

Figure 4:
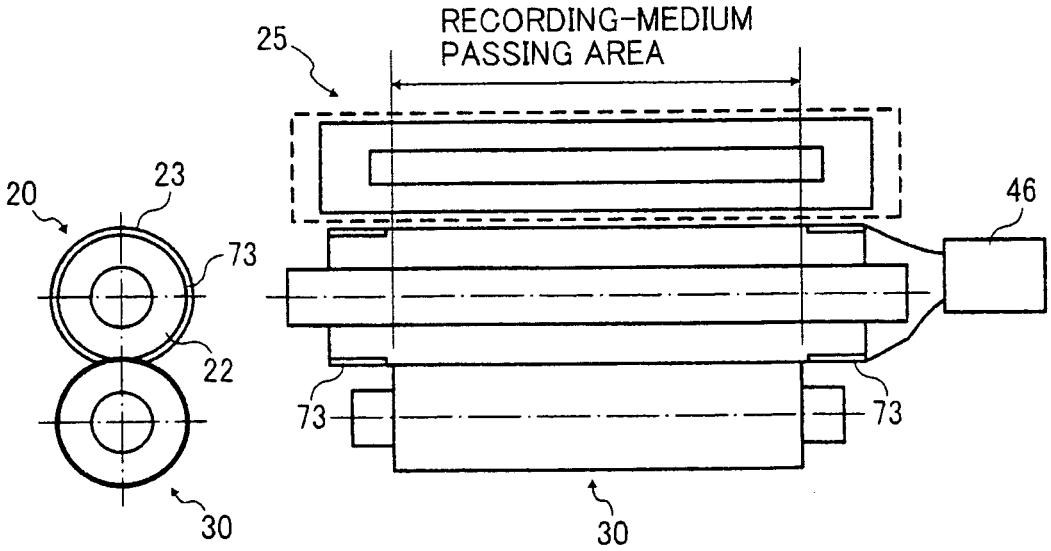
FIG. 4 is a schematic expanded cross-sectional view schematically showing a cross-section of the fixing device according to the embodiment in a state where an electromagnetic induction heating member is kept away from a fixing roller, and is a diagram showing an example in which both end portions of the fixing roller, which is the fixing member, are each covered with a conductive thin-film layer.

Subsequently, an exemplary working example of the fixing device 19 according to the present embodiment is explained with reference to FIG. 4. FIG. 4 is a schematic expanded cross-sectional view schematically showing a cross-section of the fixing device 19 according to the present embodiment in a state where the electromagnetic induction heating member 25 is kept away from the fixing roller 20, and is a diagram showing an example in which both end portions of the fixing roller 20, which is a fixing member, are each covered with a conductive thin-film layer 73. A side view of the extracted fixing roller 20 and pressure roller 30 is illustrated on the left in FIG. 4. As shown in FIG. 4, one feature of the present embodiment is that both end portions of the heat-insulating elastic layer 22 of the fixing roller 20 are each covered with the conductive thin-film layer 73. The thin-film layer 73 illustrated in this example is formed of a thin-walled metallic material, such as copper, having a conductive property (for example, with a wall thickness of about 10 micrometers), and is attached between the heat-insulating elastic layer 22 and the fixing sleeve layer 23 so as to cover the entire circumference of the surface of each end portion of the heat-insulating elastic layer 22. The thin-film layer 73 is, for example, adhered to the outer circumferential surface of the heat-insulating elastic layer 22 by a silicone adhesive or the like. Incidentally, the attachment position of the fixing roller 20 to which the thin-film layer 73 is attached is the both end portions of the fixing roller 20, and the thin-film layers 73 are attached to out of recording-medium passing area (outside of the width of a maximum-sized sheet fed) that a recording medium never passes therethrough at the fixing nip formed between the fixing roller 20 and the pressure roller 30. It is preferable to configure the fixing roller 20 in this manner because it is possible to prevent a decrease in heat insulation property at the fixing nip due to the attachment of the thin-film layers 73 and a decrease in flexibility required to form the fixing nip.

Another feature of the present embodiment is that damage detecting units 46 are connected to the respective thin-film layers 73 via electrodes in contact with the thin-film layers 73 and the like. The damage detecting unit 46 applies a fixed voltage to the thin-film layer 73, and monitors a value of current flowing through the thin-film layer 73. In FIG. 4, the damage detecting unit 46 is installed to only the thin-film layer 73 attached to one of the end portions of the fixing roller 20 (the end portion on the right side in FIG. 4); however, actually, the damage detecting unit 46 is installed to the other thin-film layer 73 attached to the other end portion of the fixing roller 20 (the end portion on the left side in FIG. 4) as well. The damage detecting unit 46 is configured to detect a change in the current value thereby detecting a change in electric resistance of the thin-film layer 73 based on a value of current flowing through the thin-film layer 73 when the damage detecting unit 46 applies the fixed voltage to the no-damaged fixing roller 20 and a value of electric resistance obtained by Ohm's law as initial values. If the heat-insulating elastic layer 22 of the fixing roller 20 is damaged or broken, the thin-film layer 73 covering the entire circumference of the heat-insulating elastic layer 22 is also damaged or broken, so electric resistance of the thin-film layer 73 changes, and a value of current flowing through the thin-film layer 73 to which the fixed voltage is applied by the damage detecting unit 46 changes from the initial value in accordance with the change in a value of the electric resistance. Incidentally, from the experience of the present applicant, the fixing roller 20 can be suddenly damaged due to long exposure to pressure from the pressure roller 30 and heat from the electromagnetic induction heating member 25 and the like in the passage of time. Therefore, by covering the outer circumferential surface of the fixing roller 20 with the thin-film layers 73 and using the damage detecting units 46 for detecting values of electric resistance of the thin-film layers 73, such sudden damage or breakage of the fixing roller 20 can be effectively detected. Besides, damage or breakage of the fixing roller 20 mostly begins in the side of the end portion thereof. From this fact, by attaching the thin-film layers 73 to the both end portions of the fixing roller 20, damage to the fixing roller 20 can be preferably detected.

The extent of damage to the fixing roller 20 is approximately proportional to a rate of change in a value of electric resistance of the thin-film layer 73. Therefore, by converting a degree of change of an electric resistance value into a ratio of the electric resistance value to the initial value described above, the extent of damage to the fixing roller 20 can be detected. The following Table 1 shows an example of the extent of damage to the fixing roller 20, a ratio of a detected current value to the initial current value, and a rate of change in a value of electric resistance.

TABLE 1

| Extent of damage to roller relative to change rate of electrical resistance value of thin film | | |
|---|---|---|
| Ratio of detected current value to initial value [%] | Change rate of electrical resistance value [%] | Thin-film damage rate = roller damage rate [%] |
| 100 (No change) | 100 (No change) | 0 |
| 95 | 105 | 5 |
| 90 | 110 | 10 |
| 85 | 115 | 15 |
| 80 | 120 | 20 |

Incidentally, in the case of the working example shown in FIG. 4, the damage detecting units 46 are installed to the both end portions of the fixing roller 20, respectively; therefore, a roller damage rate in this case is obtained by the total sum of roller damage rates detected by these damage detecting units 46. Namely, when only one of the damage detecting units 46 detects a change in the electric resistance value, only one end portion of the fixing roller 20 is damaged; therefore, only a damage rate of one of the thin-film layers 73 is detected as a roller damage rate with respect to the fixing roller 20; on the other hand, when the both damage detecting units 46 each detect a change in the electric resistance value, the total sum of damage rates of the both thin-film layers 73 is detected as a damage rate of the fixing roller 20 or the extent of damage to the fixing roller 20.

As described above, from the experience of the present applicant, it is known that damage to the fixing roller 20 mostly begins in the end portion thereof. Therefore, when damage to the fixing roller 20 is detected from a change in an electric resistance value as shown in Table 1, in most cases, the end portion of the fixing roller 20 is damaged. In this case, just because the fixing roller 20 is damaged does not mean that the image forming apparatus may still be able to perform the fixing process depending on a condition of conveyance of a recording medium to the fixing nip (a condition of feeding a recording medium to the fixing nip), such as the size or type of the recording medium; so, it is often the case that it is user-friendly if it is configured that a recording medium can be subjected to the fixing process by changing or limiting the condition of conveyance of the recording medium to the fixing nip. Therefore, the inventors of the present application developed the configuration to change and limit the condition of conveyance of a recording medium to the fixing nip when damage to the fixing roller 20 is detected.

At the time of changing the condition of conveyance of a recording medium to the fixing nip, first, as for a type of recording medium which can be subjected to image fixing sufficiently even if pressure applied to the fixing roller 20 by the pressure roller 30 is relatively reduced, it is configured that a pressing force applied to the fixing roller 20 by the pressure roller 30 is reduced depending on values of electric resistance detected by the damage detecting units 46 so that the fixing process and, eventually, the image forming operation can be performed. A type of recording medium which causes no problem in image fixing even if pressure applied to the fixing roller 20 by the pressure roller 30 is reduced include, for example, a cardboard sheet and an envelope, etc; such a type of recording medium is subjected to the fixing process under the condition that a pressing force from the pressure roller 30 is constantly reduced so as not to wrinkle the recording medium.

The configuration to reduce the pressure applied to the fixing roller 20 by the pressure roller 30 is explained with reference to FIG. 3. As explained above, in FIG. 3, there is employed the configuration that in accordance with rotation of the filler 82, the link 35 is moved toward the fixing roller 20 against the biasing force from the biasing member 31, thereby causing the pressure roller 30 being in contact with the link 35 to press against the fixing roller 20 at a desired pressure; the constant or normal pressing force can be reduced by reducing a rotation range of the filler 82. Namely, when the fixing roller 20 is damaged, with respect to a rotation range or distance of the filler 82 when the fixing roller 20 is not damaged, the rotation distance of the filler 82 is reduced, so that the pressure from the pressure roller 30 to the fixing roller 20 can be reduced.

Incidentally, when the extent of damage to the fixing roller 20 exceeds a certain level, it is conceivable that damage to the fixing device is big and serious, so, in this case, it would be better to configure not to perform the fixing process even though a type of recording medium is a cardboard sheet or an envelope, etc. Therefore, when the damage detecting unit 46 detects a certain damage rate, it is preferable to cancel the application of pressure to the fixing roller 20 by the pressure roller 30 and suspend the image forming operation. Table 2 shows an example of a degree of pressure applied to the fixing roller 20 by the pressure roller 30 when the certain damage rate of falling into suspension of the image forming operation is set to, for example, 10%.

TABLE 2

| Percentage of pressure of pressure roller relative to roller damage rate | | |
|---|---|---|
| Change rate of electrical residence [%] | Roller damage rate [%] | Percentage of pressure of pressure roller [%] |
| 100 (No more) | 0 (No change) | 100 (No change) |
| 101 to 110 | 1 to 10 | 50 |
| More than 110 | More than 10 | 0 (Suspension of image forming operation) |

In this manner, pressure applied to the fixing roller 20 by the pressure roller 30 is configured to be reduced by a pressure adjusting unit depending on the extent of damage to the fixing roller 20, so that even if the fixing roller 20 is damaged, the image forming operation can be performed depending on the recording-medium feeding condition, such as the type or size of a recording medium; therefore, it is possible to provide a user-friendly fixing device and image forming apparatus.

When the damage detecting unit 46 detects damage to the fixing roller 20, it is preferable to limit the size of a recording medium which can be introduced into the fixing nip even if a type of the recording medium is a cardboard sheet or an envelope, etc. Therefore, in the present embodiment, it is configured to limit the size of a recording medium which can be introduced into the fixing nip depending on a value of electric resistance detected by the damage detecting unit 46 and, eventually, depending on the extent of the damage to the fixing roller 20. Table 3 shows an example of a relation between a roller damage rate and the size of a recording medium which can be introduced into the fixing nip.

TABLE 3

| Size of introducible recording medium relative to roller damage rate | |
|---|---|
| Roller damage rate [%] | Size of recording medium |
| 10 or less | Postcard (100 mm) |
| 10 or less | B6T (128.5 mm) |
| 10 or less | A5T (148.5 mm) |
| 10 or less | B5T (182 mm) |
| 10 or less | A4T (210 mm) |
| 10 or less | LTT (216 mm) |
| 5 or less | B5Y (257 mm) |
| 5 or less | LTY (279 mm) |
| 5 or less | A4Y (297 mm) |

In this manner, the condition of conveyance of a recording medium to the fixing nip is changed to limit the size of a recording medium which can be introduced into the fixing nip depending on the extent of damage to the fixing roller 20, or in addition to this, pressure applied to the fixing roller 20 by the pressure roller 30 is configured to be reduced as described above, so that even if the fixing roller 20 is damaged, the image forming operation can be performed depending on the recording-medium feeding condition, such as the type or size of a recording medium; therefore, it is possible to provide a user-friendly fixing device and image forming apparatus.

To take measures to prolong the life of the fixing roller 20 in the fixing device 19, it is preferable to reduce a degree of heat applied to the fixing roller 20. This can accomplished by reducing an electric energy supplied to the electromagnetic induction heating member 25. However, in this case, it is conceivable that this results in problems, for example, that rising temperature of the fixing roller 20 to a desired temperature is reduced, or that it takes a long time to restore the temperature of the fixing roller 20, which lost heat due to passage of a recording medium subject to fixing, to a desired fixing temperature; therefore, it is preferable to configure that the feeding speed of the recording medium to the fixing nip, i.e., the passage linear speed of the recording medium is reduced thereby applying the same amount of heat as the normal recording-medium feeding condition to the recording medium. Table 4 shows an example of a relation between a change in an electric energy supplied to the electromagnetic induction heating member 25 and the feeding speed relative to the extent of damage to the fixing roller 20.

TABLE 4

| Percentage of electric energy supplied to electromagnetic induction heating unit and percentage of feeding speed relative to roller damage rate | | | |
|---|---|---|---|
| Change rate of electrical resistance value [%] | Roller damage rate [%] | Percentage of electric energy supplied to heating unit [%] | Percentage of feeding speed [%] |
| 100 (No change) | 0 (No change) | 100 (No change) | 100 (No change) |
| 101 to 110 | 1 to 10 | 50 | 50 |
| More than 110 | More than 10 | 0 (Suspension of image forming operation) | 0 (Suspension of image forming operation) |

Incidentally, for example, when a roller damage rate exceeds 10%, as described above, it is conceivable that damage to the fixing device is serious; therefore, it is preferable to stop the power supply to the electromagnetic induction heating member 25 and suspend the fixing process and the image forming operation of the image forming apparatus.

In the present embodiment, when damage to the fixing roller 20 is detected by the damage detecting unit 46, it is configured to change the condition of conveyance of a recording medium to the fixing nip depending on a value of electric resistance detected by the damage detecting unit 46 and, eventually, the extent of the damage to the fixing roller 20 so that the fixing process can be performed depending on the recording-medium feeding condition, such as a type of the recording medium; therefore, it is preferable to configure the image forming apparatus to inform a user of the extent of the damage to the fixing roller 20. For example, when it is configured to suspend the fixing process and the image forming operation if the extent of damage to the fixing roller 20 is more than 10% as in the case of the working example described above, even if damage is detected, when the extent of the damage is 10% or less, for example, on a display installed on a main body of the image forming apparatus, information that the fixing roller 20 is damaged and also the condition of conveyance of a recording medium to the fixing nip is changed and limited is displayed on a predetermined-sized screen, such as a small-sized screen, to inform a user of this information and to prompt the user to replace the fixing roller 20. On the other hand, when the extent of the damage is more than 10%, information that image formation cannot be performed is displayed on a predetermined-sized screen, such as a large-sized screen, on the display to inform a user of this information. Table 5 shows this relation.

TABLE 5

| Information to user relative to roller damage rate | | |
|---|---|---|
| Change rate of electrical resistance [%] | Roller damage rate [%] | Information to user |
| 100 (No change) | 0 (No change) | No message |
| 101 to 110 | 10 or less | Warning message on small-sized screen |
| More than 110 | More than 10 | Warning message on large-sized screen |

Incidentally, such warning information to a user is not limited to display on the display; alternatively, for example, a warning can be informed by lighting-up of a warning lamp. In this case, separate warning lamps corresponding to respective roller damage rates can be installed, or one warning lamp can be configured to light up in different colors depending on roller damage rates.

The damage detecting unit 46 is installed only to detect damage to the fixing roller 20 and recognize the extent of the damage; therefore, when no image forming job is input, for example, in a standby mode, it is not necessary to activate the damage detecting unit 46. Therefore, only when an image forming job is input, the damage detecting unit is powered on, and the damage detecting unit detects whether the fixing roller 20 is currently damaged; after completion of the image forming job, the damage detecting unit 46 is powered off. If the damage detecting unit 46 is configured like this, power consumption, for example, when the image forming apparatus is in the standby mode can be preferably reduced.

Figure 5:
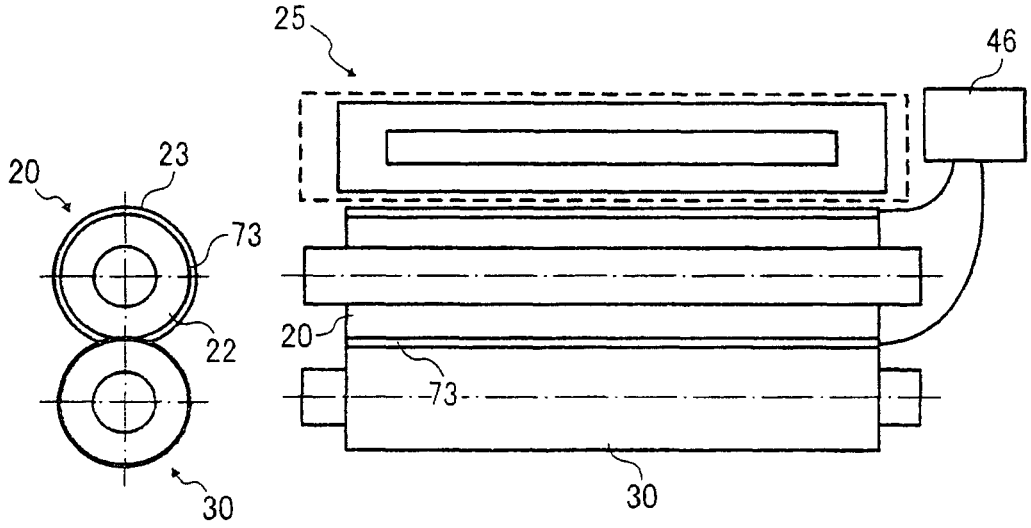
FIG. 5 is a schematic expanded cross-sectional view schematically showing a cross-section of the fixing device according to the embodiment in a state where the electromagnetic induction heating member is kept away from the fixing roller, and is a diagram showing another example, as a variation of the embodiment shown in FIG. 4, in which the entire outer circumferential surface of the fixing roller, which is the fixing member, is covered with the conductive thin-film layer.

The example in which the thin-film layers 73 are attached to the both end portions of the fixing roller 20, which are out of the recording-medium passing area, is described above. As a variation of the example, the thin-film layer 73 can be attached to the entire outer circumferential surface of the fixing roller 20 as shown in FIG. 5. Like FIG. 4, FIG. 5 is a schematic expanded cross-sectional view schematically showing a cross-section of the fixing device 19 according to the present embodiment in a state where the electromagnetic induction heating member 25 is kept away from the fixing roller 20, and is a diagram showing an example in which the entire outer circumferential surface of the heat-insulating elastic layer 22 of the fixing roller 20, which is a fixing member, is covered with the conductive thin-film layer 73. By attaching the thin-film layer 73 so as to cover the entire outer circumferential surface of the heat-insulating elastic layer 22 of the fixing roller 20 as shown in FIG. 5, damage other than damage which begins in the end portion of the fixing roller 20 can be detected. Incidentally, in the case as shown in FIG. 5, it is only necessary to install one damage detecting unit 46; therefore, the number of parts can be reduced.

Figure 6:
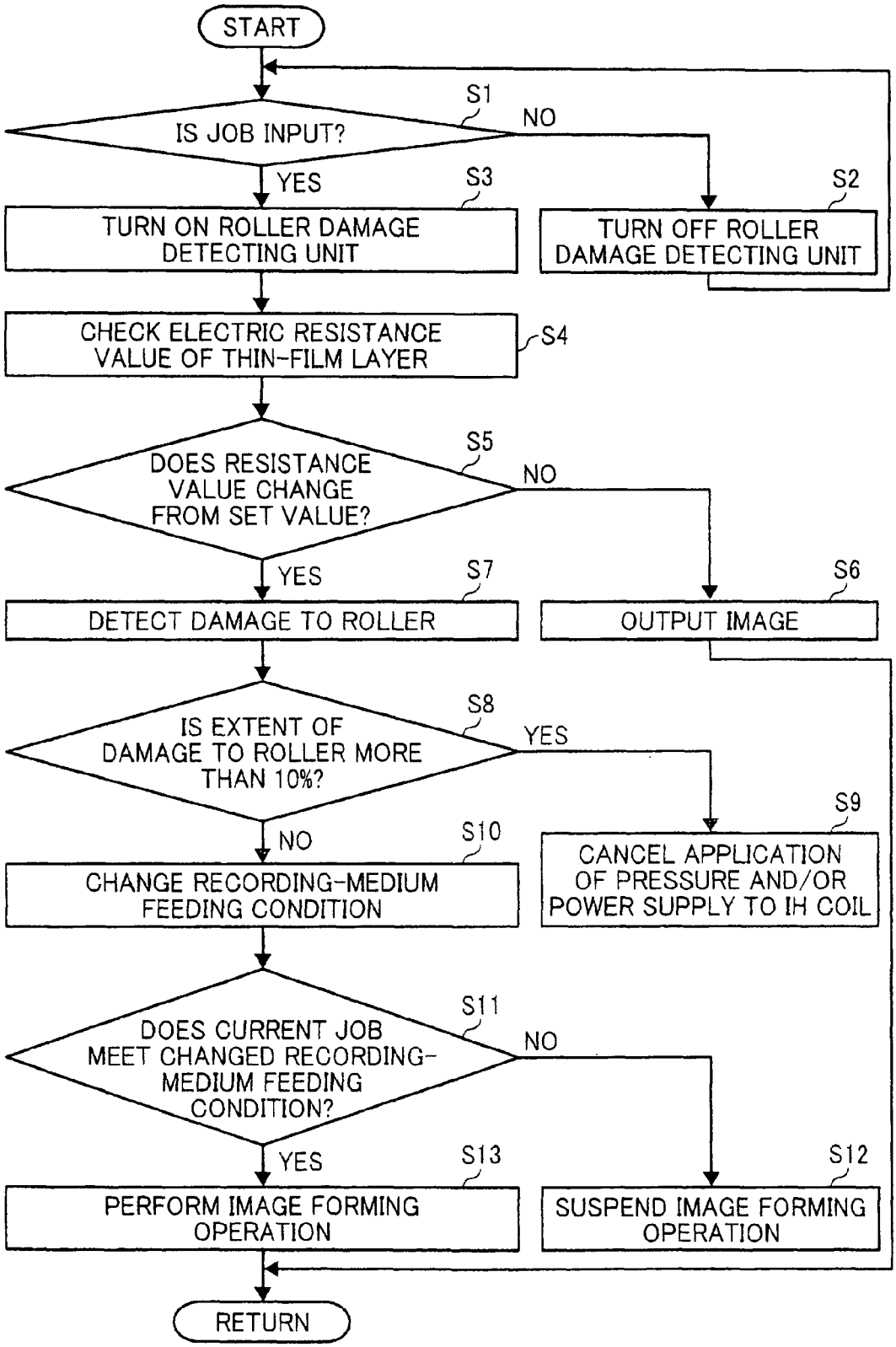
FIG. 6 is a flowchart showing an example of how the fixing device according to the embodiment controls when the fixing roller is damaged.

Subsequently, an example of how the fixing device 19 controls when the fixing roller is damaged is explained with reference to a flowchart shown in FIG. 6.

First, whether an image forming job is input to the image forming apparatus is determined (Step S1). At this time, if no image forming job is input, the damage detecting unit 46 remains turned off (Step S2); if an image forming job is input, the damage detecting unit 46 is turned on (Step S3). Then, the damage detecting unit 46 detects a current flowing through the thin-film layer 73, and detects a value of electric resistance from the current value using Ohm's law (Step S4). The damage detecting unit 46 detects whether the detected electric resistance value changes from the initial electric resistance value that the damage detecting unit 46 has detected when the fixing roller is not damaged (Step S5). At this time, if there is no change in the electric resistance value, the fixing roller 20 is not damaged, so the image forming operation is performed (Step S6). On the other hand, if there is a change in the electric resistance value, it is determined that the fixing roller 20 is damaged (Step S7). When damage to the fixing roller 20 is detected, the extent of the damage to the fixing roller 20 is determined from a change rate of the electric resistance value, and whether the extent of the damage is, for example, more than 10% is determined (Step S8). If the extent of the damage is more than 10%, the application of pressure to the fixing roller 20 by the pressure roller 30 is cancelled via the pressure adjusting unit, and the image forming operation is suspended or cancelled (Step S9). At this time, power supply to the electromagnetic induction heating member 25 can be stopped at the same time. Further, information that image formation cannot be performed due to the damage to the fixing roller 20 is informed to a user, for example, by displaying the information on the display or using an indicator lamp, etc. installed on the image forming apparatus. On the other hand, if the extent of the damage to the fixing roller is 10% or less, the condition of conveyance of a recording medium to the fixing nip, i.e., the recording-medium feeding condition is changed (Step S10), and whether the image forming operation can be performed is determined (Step S11). At this time, the recording-medium feeding condition changed includes the size of a recording medium which can be fed, pressure applied to the fixing roller 20 by the pressure roller 30, and the like. If the currently-input image forming job cannot be performed under the changed recording-medium feeding condition, the image forming operation is suspended or cancelled (Step S12), and the image forming apparatus informs a user that image formation can be performed only on a prescribed recording medium because the fixing roller 20 is damaged, and prompts the user to replace the fixing roller 20, for example, using the display or the indicator lamp, etc. If the currently-input image forming job can be performed under the changed recording-medium feeding condition, the image forming operation is performed under the changed recording-medium feeding condition (Step S13). Incidentally, even when the image forming operation is performed at this time, the image forming apparatus informs a user that subsequent image formation can be performed only on a prescribed recording medium because the fixing roller 20 is damaged, for example, using the display or the indicator lamp, etc.

Figure 7:
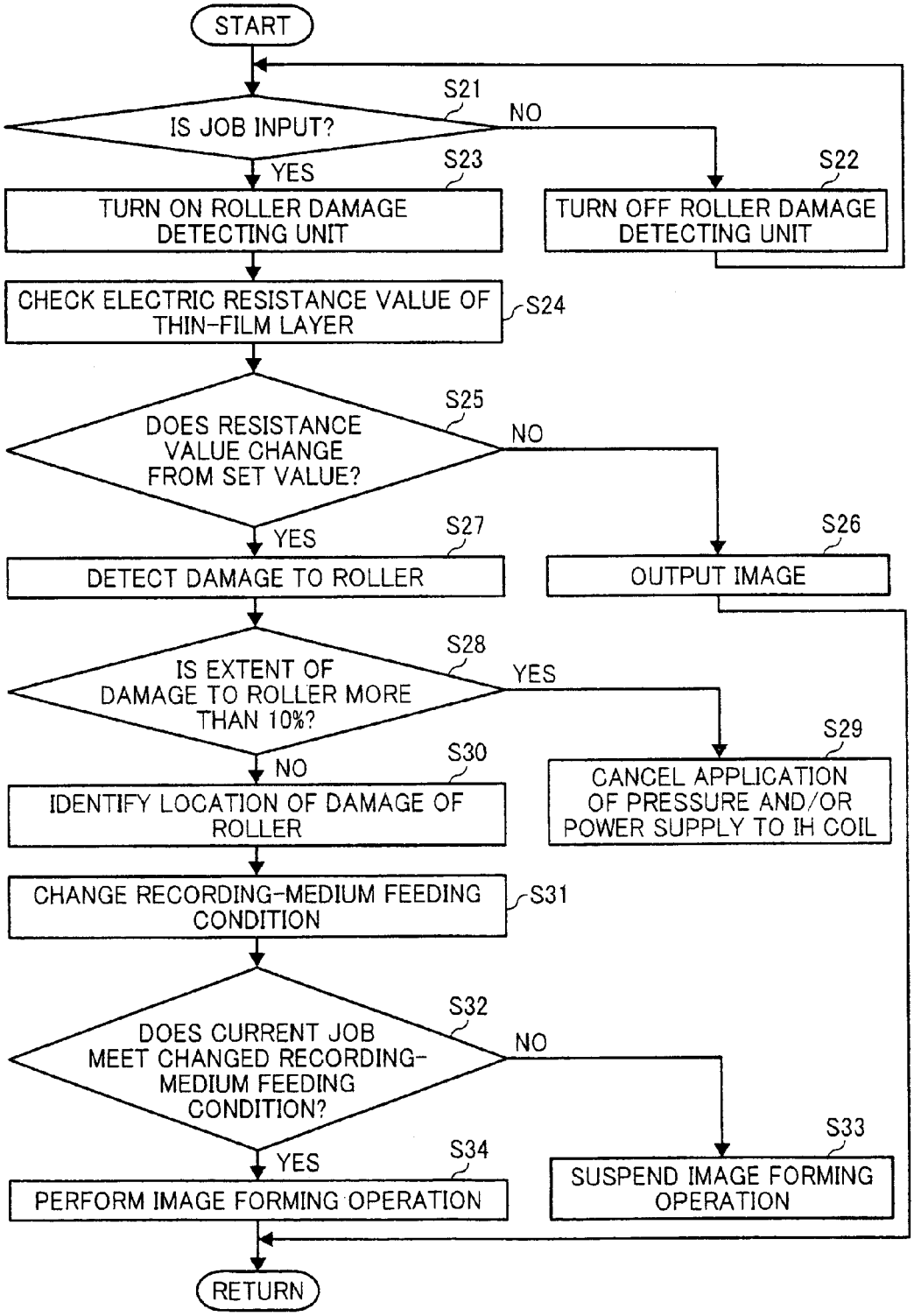
FIG. 7 is a flowchart showing another example of how the fixing device according to the embodiment controls when the fixing roller is damaged.

Lastly, another example of how the fixing device 19 controls when the fixing roller is damaged in this embodiment is explained with reference to a flowchart shown in FIG. 7.

First, whether an image forming job is input to the image forming apparatus is determined (Step S21). At this time, if no image forming job is input, the plurality of damage detecting units 46 all remain turned off (Step S22); if an image forming job is input, all the damage detecting units 46 are turned on (Step S23). Then, the damage detecting units 46 each detect a current flowing through the corresponding thin-film layers 73, and each detect a value of electric resistance from the detected current value using Ohm's law (Step S24). The damage detecting units 46 each detect whether the detected electric resistance value changes from the initial electric resistance value that the damage detecting unit 46 has detected when the fixing roller 20 is not damaged (Step S25). At this time, if the electric resistance values of all the thin-film layers 73 are unchanged, the fixing roller 20 is not damaged in any location, so the image forming operation is performed (Step S26). On the other hand, if the electric resistance value of any of the thin-film layers 73 changes from the initial value, it is determined that there is damage to the fixing roller 20 (Step S27). When damage to the fixing roller 20 is detected, the extent of the damage to the fixing roller 20 is determined from a change rate of the electric resistance value, and whether the extent of the damage is, for example, more than 10% is determined (Step S28). If the extent of the damage is more than 10%, the application of pressure to the fixing roller 20 by the pressure roller 30 is cancelled via the pressure adjusting unit, and the image forming operation is suspended or cancelled (Step S29). At this time, power supply to the electromagnetic induction heating member 25 can be stopped at the same time. Further, information that image formation cannot be performed due to the damage to the fixing roller 20 is displayed, for example, on the display or the like installed on the image forming apparatus. On the other hand, if the extent of the damage to the fixing roller is 10% or less, next, location of the damage of the fixing roller 20 is identified (Step S30). The location of the damage is identified by identifying which location on the fixing roller 20 where the thin-film layer 73 of which the electric resistance value changes from the initial value out of the plurality of thin-film layers 73 is arranged. Then, the condition of conveyance of a recording medium to the fixing nip, i.e., the recording-medium feeding condition is changed (Step S31), and whether the image forming operation can be performed is determined (Step S32). At this time, the recording-medium feeding condition changed includes the size of a recording medium which can be fed to the location of the damage, pressure applied to the fixing roller 20 by the pressure roller 30, and the like. If the currently-input image forming job cannot be performed under the changed recording-medium feeding condition, the image forming operation is suspended or cancelled (Step S33), and the image forming apparatus informs a user that image formation can be performed only on a prescribed recording medium because the fixing roller 20 is damaged, and prompts the user to replace the fixing roller 20, for example, using the display or the indicator lamp, etc. installed on the main body of the image forming apparatus. If the currently-input image forming job can be performed under the changed recording-medium feeding condition, the image forming operation is performed under the changed recording-medium feeding condition (Step S34). Incidentally, even when the image forming operation is performed at this time, the image forming apparatus informs a user that subsequent image formation can be performed only on a prescribed recording medium because the fixing roller 20 is damaged, for example, using the display or the indicator lamp, etc.

According to an embodiment of the present invention, a conductive thin-film layer is provided to a heat-insulating elastic layer of a fixing member, and a damage detecting unit for detecting the electric resistance of the thin-film layer is installed to the thin-film layer. The damage detecting unit is configured to detect a change in the electric resistance of the thin-film layer. With this, damage to the thin-film layer which is damaged with damage to the heat-insulating elastic layer can be detected from the change in the electric resistance of the thin-film layer. Moreover, since the change of the electric resistance is closely related to the extent of damage to the fixing member, the extent or rate of damage to the fixing member can be recognized from a degree or rate of the change of the electric resistance value. Furthermore, damage to the fixing member mostly begins in an end portion thereof, so, by changing a condition of conveyance of a recording medium to a fixing nip depending on the extent of the damage to the fixing member, and also depending on a change in the detected electric resistance, a fixing process can be performed depending on a recording-medium feeding condition, such as the type of the recording medium or the size of the recording medium. Therefore, it is possible to provide a user-friendly fixing device and image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an electromagnetic induction heating member including a coil that is powered by application of an alternating voltage and generates an alternating magnetic flux by an alternating current passing therethrough;

a fixing member including a fixing sleeve provided with a heating layer that is heated by action of the alternating magnetic flux generated by the coil, a heat-insulating elastic layer located on inner circumference side of the fixing sleeve, and a conductive thin-film layer provided to the heat-insulating elastic layer;

a pressure member that presses against the fixing member to form a fixing nip between the fixing member and the pressure member, such that an unfixed toner image is fixed on a recording medium conveyed to the fixing nip by heat from the fixing sleeve provided with the heating layer heated by the magnetic flux generated by the coil and pressure applied to the fixing member by the pressure member; and a damage detecting unit that detects electric resistance of the thin-film layer, wherein the damage detecting unit detects a change in the electric resistance of the thin-film layer to detect damage to the fixing member, and the fixing device changes a condition of conveyance of the recording medium to the fixing nip if the damage detecting unit detects damage to the fixing member.

2. The fixing device according to claim 1, wherein the fixing device reduces the pressure applied to the fixing member by the pressure member to change the condition of conveyance of the recording medium to the fixing nip.

3. The fixing device according to claim 1, wherein the fixing device limits size of a recording medium which can be introduced into the fixing nip to change the condition of conveyance of the recording medium to the fixing nip.

4. The fixing device according to claim 1, wherein the thin-film layer is provided to both end portions of the fixing member, which are out of a recording-medium passing area, and the damage detecting unit is provided correspondingly to the thin-film layer.

5. The fixing device according to claim 1, wherein when damage to the fixing member is detected, depending on an electric resistance value detected by the damage detecting unit, power supply to the coil is reduced, and passing speed of the recording medium passing through the fixing nip is reduced.

6. The fixing device according to claim 1, wherein when damage to the fixing member is detected, depending on an electric resistance value detected by the damage detecting unit, application of the pressure to the fixing member by the pressure member is cancelled.

7. The fixing device according to claim 1, wherein when damage to the fixing member is detected, depending on an electric resistance value detected by the damage detecting unit, power supply to the coil is cancelled.

8. The fixing device according to claim 1, wherein when damage to the fixing member is detected, it is configured to inform a user of extent of the damage depending on an electric resistance value detected by the damage detecting unit.

9. The fixing device according to claim 1, wherein when image forming operation is not performed, the damage detecting unit is powered off.

10. The fixing device according to claim 1, wherein the thin-film layer includes a plurality of conductive thin-film layers that are provided in spaced apart relation across a full width of the heat-insulating elastic layer of the fixing member, the damage detecting unit includes a plurality of damage detecting units that detect electric resistance of the thin-film layers, respectively, the damage detecting units each detect a change in an electric resistance value of corresponding one of the thin-film layers to detect damage to the fixing member and location of the damage, and when the damage detecting units detects damage to the fixing member and identifies location of the damage, the fixing device changes the condition of conveyance of the recording medium to the fixing nip.

11. The fixing device according to claim 10, wherein when damage to the fixing member is detected and location of the damage is identified, depending on electric resistance values and the location of the damage detected by the damage detecting units, power supply to the coil is reduced, and passing speed of the recording medium passing through the fixing nip is reduced.

12. The fixing device according to claim 10, further comprising a pressure adjusting unit that causes, when damage to the fixing member is detected and location of the damage is identified, depending on electric resistance values and the location of the damage detected by the damage detecting units, the pressure member to cancel application of the pressure to the fixing member.

13. The fixing device according to claim 10, wherein when damage to the fixing member is detected and location of the damage is identified, depending on electric resistance values and the location of the damage detected by the damage detecting units, power supply to the coil is cancelled.

14. The fixing device according to claim 10, wherein when damage to the fixing member is detected and location of the damage is identified, it is configured to inform a user of extent of the damage and the location of the damage depending on electric resistance values and the location of the damage detected by the damage detecting units.

15. The fixing device according to claim 10, wherein when image forming operation is not performed, the damage detecting units are all powered off.

16. An image forming apparatus comprising a fixing device that includes:

an electromagnetic induction heating member including a coil that is powered by application of an alternating voltage and generates an alternating magnetic flux by an alternating current passing therethrough;

a fixing member including a fixing sleeve provided with a heating layer that is heated by action of the alternating magnetic flux generated by the coil, a heat-insulating elastic layer located on inner circumference side of the fixing sleeve, and a conductive thin-film layer provided to the heat-insulating elastic layer;

a pressure member that presses against the fixing member to form a fixing nip between the fixing member and the pressure member, such that an unfixed toner image is fixed on a recording medium conveyed to the fixing nip by heat from the fixing sleeve provided with the heating layer heated by the magnetic flux generated by the coil and pressure applied to the fixing member by the pressure member; and a damage detecting unit that detects electric resistance of the thin-film layer, wherein the damage detecting unit detects a change in the electric resistance of the thin-film layer to detect damage to the fixing member, and the fixing device changes a condition of conveyance of the recording medium to the fixing nip if the damage detecting unit detects damage to the fixing member.

* * * * *